US005135015A

United States Patent [19]

Young

[11] Patent Number: 5,135,015

[45] Date of Patent: Aug. 4, 1992

[54] PRESSURIZED FLUID CLEANING DEVICE

[75] Inventor: Carl R. Young, Deerfield Beach, Fla.

[73] Assignee: Young's Hovercover, Inc., Pompano Beach, Fla.

[21] Appl. No.: 479,348

[22] Filed: Feb. 12, 1990

[51] Int. Cl.[5] ..... B08B 3/02

[52] U.S. Cl. ..... 134/179; 134/172; 239/288.5; 15/320

[58] Field of Search ..... 134/179, 172, 176, 177; 239/251, 288, 288.5; 15/98, 320

[56] References Cited

U.S. PATENT DOCUMENTS

| | | | |
|---|---|---|---|
| 3,672,380 | 6/1972 | Schuster | 239/288.5 |
| 3,807,632 | 4/1974 | Johnson, Jr. | 239/288.5 |
| 3,829,019 | 8/1974 | Petsch | 239/251 |
| 3,831,848 | 8/1974 | Cook | 239/288.5 |
| 4,047,666 | 9/1977 | Hart | 239/251 |
| 4,191,589 | 3/1980 | Halls et al. | 134/176 |
| 4,191,590 | 3/1980 | Sundheim | 239/251 |
| 4,199,896 | 4/1980 | Lehman | 239/288.5 |
| 4,821,961 | 4/1989 | Shook | 239/253 |
| 4,895,179 | 1/1990 | Hart | 134/179 |

*Primary Examiner*—William A. Cuchlinski, Jr.
*Assistant Examiner*—William C. Dowling
*Attorney, Agent, or Firm*—Malin, Haley, McHale, DiMaggio & Crosby

[57] ABSTRACT

A surface cleaning device utilizing a pressurized flow of cleaning fluid from opposite ends of a rotatable shaft disposed under a generally cylindrical shallow housing, said nozzles being disposed at transverse angles to the elongate axis of said rotatable shaft such that the thrust created by discharge of cleaning fluid therefrom causes rotation of said rotatable shaft and thus cleaning action on a surface to be cleaned. In operation, the pressurized flow of cleaning fluid is passed through a swivel connection associated with the housing and into the rotating arm/nozzle apparatus. The cleaning fluid discharging from the discharge nozzles creates a thrust, and the angle of inclination of the discharge port of the nozzles relative to vertical creates a thrust and hence self-rotating motion to the nozzle/rotating arm apparatus. Fluid under pressure is generally contained between the housing and the surface being cleaned, therefore creating an intense agitational efficient cleaning environment and an increased ambient pressure under the housing, giving rise to a lifting force to the housing, which assists in maneuverability of the device during operation.

1 Claim, 2 Drawing Sheets

PRESSURIZED FLUID CLEANING DEVICE

FIELD OF THE INVENTION

The invention relates to cleaning devices and more specifically to a device for cleaning surfaces with pressurized liquid.

DESCRIPTION OF THE PRIOR ART

Numerous devices have been presented in the past for cleaning by spraying fluid within a controlled volume. The following U.S. Patent references represent illustrative examples:

| | |
|---|---|
| NORTH | U.S. Pat. No. 2,589,020 |
| SHUSTER | U.S. Pat. No. 3,672,380 |
| JOHNSON | U.S. Pat. No. 3,807,632 |
| LEHMAN | U.S. Pat. No. 4,199,896 |
| SHOOK | U.S. Pat. No. 4,821,961 |

The SHUSTER and LEHMAN devices have essentially bell shaped hoods to contain the spray from the devices' nozzles, but lack a self-rotating spray nozzle and hovering feature.

NORTH has both multiple nozzles and a spray containment hood, but lacks self-rotating nozzles.

SHOOK discloses rotating nozzles but does not suggest a containment hood nor hovering action.

JOHNSON teaches a fluid containment hood and elevation of the device by fluid pressure within the containment hood but does not disclose a self-rotating nozzle structure.

The prior art does not disclose a pressure cleaning device employing a confined agitational surface cleaning chamber which device hovers above the surface being cleaned, thereby assisting greatly in the maneuvering of the device.

SUMMARY OF THE INVENTION

The instant invention discloses a surface cleaning device adapted to easily clean any surface regardless of orientation comprising a cleaning fluid supply means fluidly connected to a rotatable arm, the cleaning fluid supply means being integrally connected to a cleaning fluid spray containment shroud means for housing, the shroud means adapted to envelop the rotatable arm thereby creating a confined cleaning chamber, the arm having opposed terminal ends which are connected to a pair of cleaning fluid discharge nozzles disposed at transverse angles relative to the elongate axis of the rotatable arm.

Cleaning fluid is placed under pressure and fed to the cleaning fluid supply means via a flexible feed conduit and passes through the hollow interior of the rotatable arm and out the pair of angled discharge nozzles toward the surface to be cleaned. The fluid discharging from the nozzles creates the hydrodynamic effect of thrust back against the nozzles which in turn causes the rotatable arm to rotate in fluid communication with the cleaning fluid supply means. A swivel housing is provided for sealing the rotatable arm to the non-rotatable fluid supply means and housing.

In operation, the ambient pressure between the housing and the surface being cleaned is increased relative to the ambient pressure outside of the housing, giving rise to a lifting of the invention away from the surface being cleaned, thereby aiding in moving the device along the surface being cleaned. The high energy stream of cleaning fluid emitting from the rapidly rotating arm creates a cleaning and agitating atmosphere under the shroud means. The thrust created by the cleaning fluid exiting the nozzles contributes to the lifting phenomenon of the shroud means because there is a force component attributable to the thrust force in the vertical direction, as well as the component in the horizontal direction which is responsible for the rotation of the hollow shaft.

The invention is preferably provided with handle means for manipulation thereof by an operator.

It is therefore an object of this invention to present a spray cleaning device that supports itself away from the surface being cleaned to aid in manuevering the invention.

It is a further object of the invention to create a spray cleaning device that combines rotating nozzles and a spray containment structure.

It is still further an object of the invention to create a spray cleaning device with rotating nozzles wherein the impetus for rotating said nozzles is supplied by the thrust of ejected cleaning fluid.

In accordance with these and other objects which will be apparent hereinafter, the instant invention will now be described with particular reference to the accompanying drawings.

DETAILED DESCRIPTION OF THE PREFERRED EMBODIMENT

Figure 3:
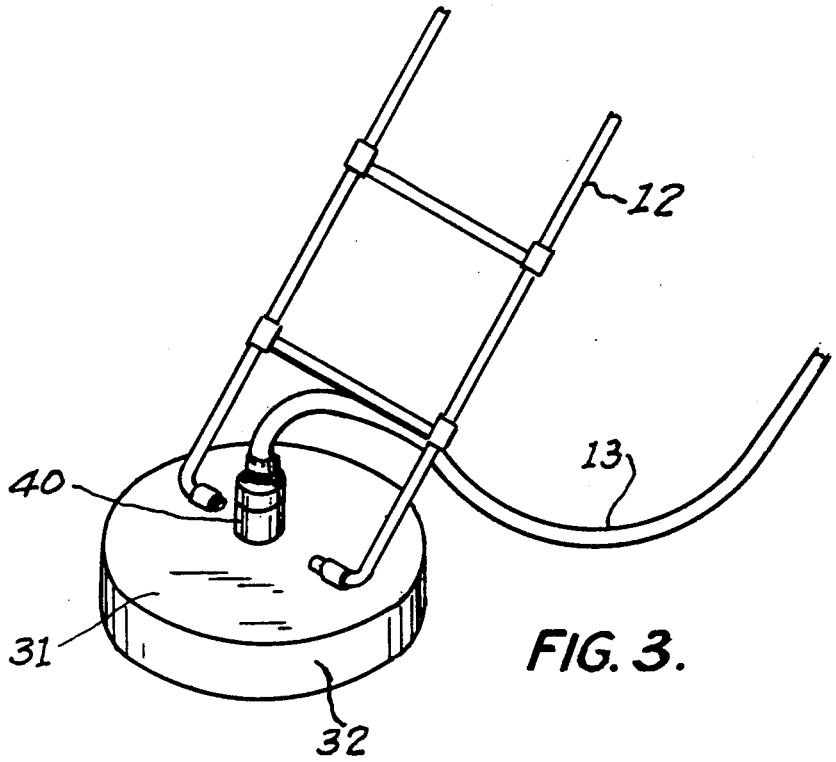
FIG. 3 is a top perspective view of the invention in its intended position for use with a cleaning fluid supply means fluidly connected to a source of pressurized fluid.

Referring now to the drawings, there is disclosed herein a pressurized fluid cleaning device designated generally by the reference numeral 10. The cleaning device is comprised of a housing means 30, which is preferably a shallow cylindrical member with a cover member integrally connected thereto, the cover member having means to allow a user to manipulate the device such as handles 12, as best seen in FIG. 3.

A supply of pressurized cleaning fluid is supplied via feed line means 13. Feed line means 13 is connected at its remote end to a source means of said pressurized cleaning fluid (not shown) and is threadably connected at its proximal end to swivel body 40. Swivel body 40 has a top part 41 and a bottom part 42 held together by fastening bolts 43. Feed line means 13 is connected to swivel body 40 at top part 41.

Top part 41 has a bore 44 extending throughout top part 41 and a cavity 45 at the lower end of top part 41. Bottom part 42 has a bore 46 which extends through bottom part 42. Top part 41 is rigidly connected to bottom part 42 which is rigidly connected to housing 30, allowing the flow of pressurized cleaning fluid to pass into the interior cleaning chamber 33 within housing 30.

A rotatable hollow shaft member 20 is positioned in bore 46 of bottom part 42. A pair of discharge nozzles 39 are mounted at opposing ends of transverse shaft 35, which transverse shaft 35 is in turn threadably connected to the hollow shaft member 20 by "T"-unit 38.

Threadably and coaxially mounted in hollow shaft member 20 opposite the "T"-unit 38 is annular seat 23.

Pilot conduit 24 is mounted in bore 44 and has a downward extending rim 25 and guide engaging arms 29. Guides 48 and 49 are mounted in top part 41 and extend downward into cavity 45 and through apertures in guide engaging arms 29. Pilot conduit 24 slides up and down in cavities 44 and 45 constrained in side to side movement by the walls of top part 41 and in rotation around its longitudinal axis by the interaction of guide engaging arms 29 and guides 48 and 49.

Compression spring 26 biases pilot conduit 24 into contact with seat 23. Compression spring 26 is chosen to maintain contact between seat 23 and pilot conduit 24, including rim 25, despite the tendancy of pilot conduit 24 and seat 23 to separate due to fluid pressure within the device 10. Rim 25 aids in directing fluid pressure from pilot conduit 24 to hollow shaft member 20, thus reducing the tendency of pilot conduit 24 and seat 23 to separate.

Figure 1:
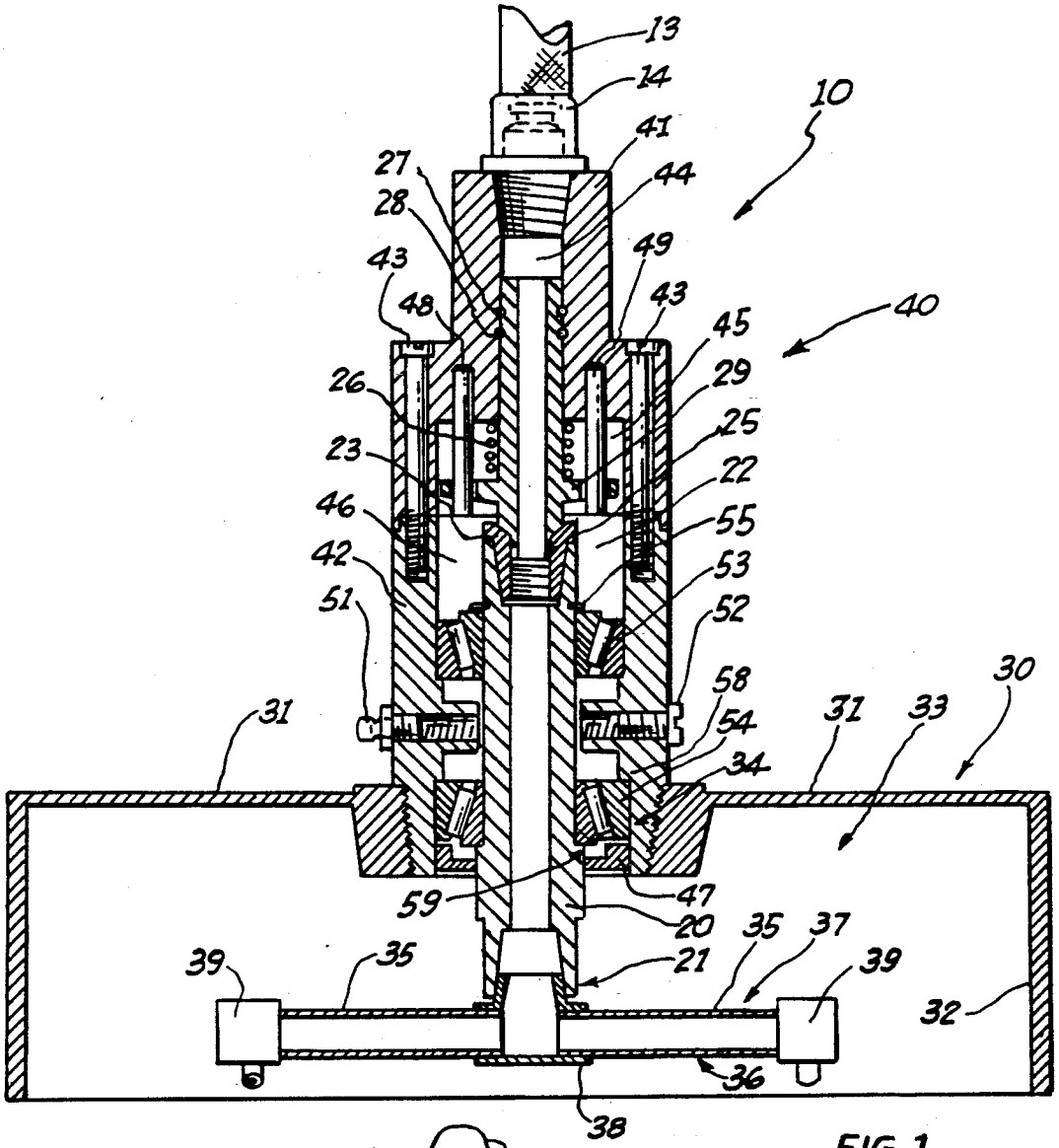
FIG. 1 is a cross-sectional side view of the invention.
Figure 2:
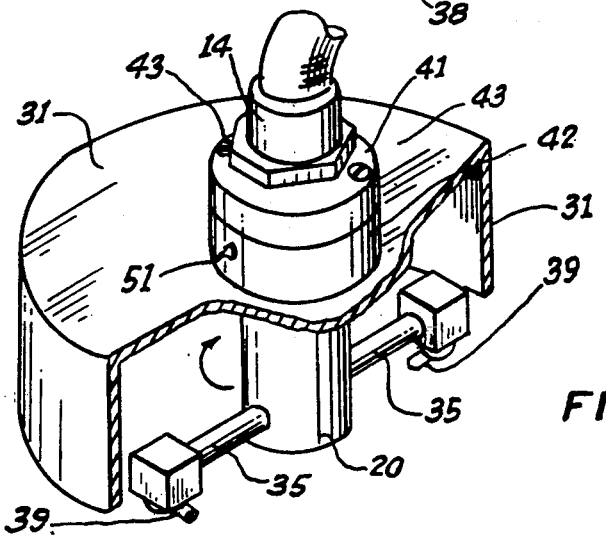
FIG. 2 is a perspective view of the invention with the outer housing partially cut away.

Nozzles 39 fluidly communicate with feed line mean 13 through transverse shaft 35, hollow shaft member 20, pilot conduit 24 and then to feed line means 13 as shown in FIG. 1. Nozzles 39 are oriented at transverse angles relative to the elongated center line of transverse shaft 35 such that the thrust created by fluid discharging from nozzles 39 causes transverse shaft 35 to rotate in proportion to the velocity and pressure of the discharging cleaning fluid. Nozzles 39 at the respective ends of transverse shaft 35 are preferably disposed at identical but opposite angles to each other as shown in FIG. 2.

In FIG. 1 is illustrated bottom part 42 of swivel body 40 which encases rotatable hollow shaft 20. Shaft 20 has a lower end 21 and an open upper end 22 wherein said seat 23 is threadably connected. Shaft 20 is held in place within bottom part 42 by upper roller thrust bearing 53 and lower roller thrust bearing 54 which allows shaft 20 to rotate about its longitudinal axis, but constrain any side to side movement of shaft 20. Upper roller thrust bearing 53 is held in place within bore 46 by snap ring 55 mounted in a groove in hollow shaft 20. Lower roller thrust bearing 54 is held in place within bore 46 by its contact with bottom part lip 58 and shaft lip 59 in hollow shaft 20.

Grease fitting 51 allows grease to be inserted under pressure into bore 46 and consequently through upper and lower roller thrust bearings 53, 54, thereby lubricating them. Grease drain plug 52 may be removed to allow old grease to be expunged by pressure from the new grease inserted through grease fitting 51. Grease is prevented from travelling into cleaning chamber 33 by sealing cap 47 at the lower end of bore 46. Grease cap 47 also prevents fluid present in cleaning chamber 33 from intruding into bore 46.

In order that the supply of pressurized cleaning fluid is efficiently directed through pilot conduit 24, shaft 20, and out transverse shaft 35 to discharge through nozzles 39, pilot conduit 24 is sealingly associated with top part 41 by the use of upper and lower 0-rings 28 and 27, respectively. Both lower and upper 0-ring 27, 28 are positioned between pilot conduit 24 and top part 41 as best shown in FIG. 1.

Integrally connected into diametrically opposite sides of T-unit 38 at the lower end 21 of the shaft 20 are a pair of transverse tubes 35 each having a mountable end 36 and a nozzle end 37. The tubes 35 are preferably each mounted at their respective mountable ends 36 to T-unit 38 by screw-type means whereby the mountable end 36 of the tubes 35 are sealingly threaded into T-unit 38 which is in turn sealingly threadably connected to the lower end 21 of shaft 20. Tubes 35 fluidly communicate the interior of shaft 20 with the discharge nozzles 39, thereby allowing cleaning fluid under pressure to flow from its source (not shown) through feed line means 13, bore 44, pilot conduit 24, shaft 20, T-unit 38, transverse shaft 35, and out through nozzles 39 into cleaning chamber 33 defined by housing 30.

Attached to the nozzle end 37 of each tube 35 is a nozzle 39. Nozzle 39 is threadably attached to the nozzle end 37 of the tubes 35 and has a discharge outlet to direct the pressurized cleaning fluid flow as desired. Nozzle 39 is aimed in a substantially downward and outward direction so that the thrust created by fluid discharging therefrom causes shaft 20 to rotate at high speed. The nozzle can be any of a variety common in the industry and can be of either the common type or the cavitation type as described in U.S. Pat. No. 3,807,632.

The outer housing 30 forms an outer casing for the cleaning chamber 33. The substantially horizontal top portion 31 of the housing 30 threadably receives bottom part 41 at threads 34 so as to rigidly and sealingly secure bottom part 41 to the housing 30. Extending downwardly from the outermost edge of the top 31 in a cylindrical fashion around the disc formed by top portion 31 is a containment wall 32 that is made of rigid material and extends downward from top portion 31 to a point below the nozzles 39, typically a few inches. The containment wall 32 material may be high impact plastic, hard rubber, plexiglass, metal or the like. The substantially horizontal top portion 31 and containment wall 32 completely enclose transverse shafts 35 and nozzle attachments 39 a they rotate with shaft 20.

When pressurized fluid is directed down the shaft 20, it passes down to the lower end 21 of shaft 20, through T-unit 38 and then outwardly through the tubes 35 to the substantially downwardly directed nozzles 39. The force of pressurized liquids leaving the nozzles 39 creates an upward thrust on tubes 35 which is transmitted to swivel body 40 through lower thrust bearing 54 and pilot conduit 24 in combination with compression spring 26, and subsequently to housing 30 through the connection of housing 30 and bottom part 41 of swivel body 40 at threads 34. In addition, an environment of elevated ambient pressure is created within cleaning chamber 33 relative to the environment external to housing 30, so that the entire device is elevated above the surface to be cleaned. By varying the pressure, physical parameters of the nozzles 39, and the downward length of the containment wall 32, the height that the device will hover or be elevated above the surface to be cleaned can be controlled.

Each of nozzles 39, in addition to being substantially downwardly directed, is also directed slightly and oppositely in a direction best described as rotated about the longitudinal axis of the tubes 35. Such orientation of nozzles 39 produces a transverse thrust on tubes 35 when pressurized fluid is forced through the nozzles 29 such that tubes 35 will begin to rotate in a direction around the longitudinal axis of shaft 20. The optimum degree of rotation of nozzles 39 from a direction directly downward in order to provide the most useful combination of transverse thrust and lift has been found to be about 15 degrees from vertical. However, the invention is not limited to nozzles 39 rotated by 15 degrees, and the 15 degree rotation is merely exemplary.

Such rapid rotation of tubes 35 will of necessity include rotation of nozzles 39 with the accompanying effect that nozzles 39 will rapidly move across sections being cleaned, imparting a strong agitational cleaning force thereto. The pressurized stream of fluid issuing from each nozzle 39 will impact upon the surface to be cleaned and break apart and/or wash away undesired matter.

FIG. 3 is a perspective view of the device showing the top 31 and containment wall 32 of housing 30 as well as swivel body 40 connected at one end to housing 30 and connected at the other end to fluid feed means 13 for transporting pressurized fluid to the device.

Figure 4:
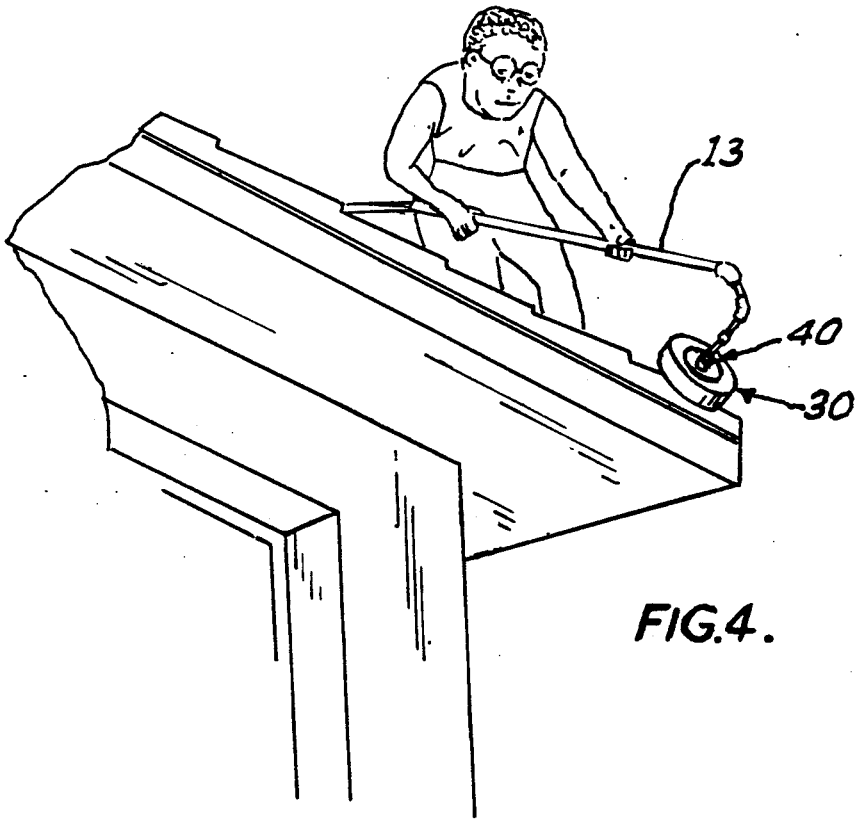
FIG. 4 is a perspective view of the invention in use on a house roof.

FIG. 4 is a perspective view of an alternative embodiment of the device in use to clean a roof. In this embodiment, the housing 30 and swivel body 40 are identical to the embodiment described above. However, the fluid feed means 13 is made of a rigid material which also serves as a handle to control and direct the invention.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. A surface cleaning device utilizing a pressurized flow of cleaning fluid, comprising:

a housing means comprising a generally cylindrical shroud having a closed top and an open bottom, said shroud defining a downwardly facing cleaning chamber;

a plurality of generally horizontally disposed conduits, each of said conduits having a terminal end and a distal end;

means for rotatably, and sealingly, connecting said conduits to said housing means, said means for rotatably connecting said conduits to said housing means includes a lower member fixed in relationship to said housing means, an upper member likewise fixed in relationship to said housing means, an upper fluid conveyance shaft, and a lower fluid conveyance shaft, said lower fluid conveyance shaft being rotatable with respect to said housing means and fluidly communicating said upper fluid conveyance shaft with said conduits, said upper fluid conveyance shaft being coaxial with and fluidly communicating said lower fluid conveyance shaft with a fluid supply means;

said fluid supply means fluidly communicating a source of pressurized cleaning fluid to said conduits;

each of said conduits having a discharge nozzle means connected to the distal end thereof for discharging said pressurized flow of cleaning fluid therefrom, said nozzles being oriented to discharge said cleaning fluid generally downwardly at a transverse angle relative to a horizontal plane, said nozzle means facing in opposite directions relative to each other;

whereby the flow of said pressurized cleaning fluid through said nozzle means causes said rotatable conduits to rotate, thus dispersing the flow of cleaning fluid in a circular pattern within said cleaning chamber;

handle means for manipulating said cleaning device;

upper and lower thrust bearing means adapted to permit free rotation of said lower fluid conveyance shaft relative to said upper fluid conveyance shaft;

a seat member connected to the uppermost end of said lower fluid conveyance shaft;

means for biasing said upper fluid conveyance shaft into sealing engagement with said seat, said seat being rotatable with respect to said upper fluid conveyance shaft.

* * * * *